US011585343B2

(12) United States Patent
Shimizu

(10) Patent No.: US 11,585,343 B2
(45) Date of Patent: Feb. 21, 2023

(54) MUFFLER FOR A COMPRESSION MECHANISM OF A ROTARY COMPRESSOR

(71) Applicant: DAIKIN INDUSTRIES, LTD., Osaka (JP)

(72) Inventor: Takashi Shimizu, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 313 days.

(21) Appl. No.: 16/630,255

(22) PCT Filed: Jul. 10, 2018

(86) PCT No.: PCT/JP2018/026064
§ 371 (c)(1),
(2) Date: Jan. 10, 2020

(87) PCT Pub. No.: WO2019/017248
PCT Pub. Date: Jan. 24, 2019

(65) Prior Publication Data

US 2021/0095671 A1 Apr. 1, 2021

(30) Foreign Application Priority Data

Jul. 19, 2017 (JP) ..... JP2017-140066

(51) Int. Cl.
*F04C 29/06* (2006.01)
*F04C 23/00* (2006.01)
*F04C 29/12* (2006.01)

(52) U.S. Cl.
CPC ..... *F04C 29/061* (2013.01); *F04C 23/008* (2013.01); *F04C 29/12* (2013.01);
(Continued)

(58) Field of Classification Search
CPC ..... F04C 29/068; F04C 2240/30; F04C 2240/804; F04C 2240/806; F04C 2250/10;
(Continued)

(56) References Cited

U.S. PATENT DOCUMENTS 5,203,679 A * 4/1993 Yun ..... F04C 29/068 181/269
6,176,687 B1 * 1/2001 Kim ..... F04C 29/061 181/403
(Continued)

FOREIGN PATENT DOCUMENTS

CN 1243204 A 2/2000
CN 1499082 * 5/2004
(Continued)

OTHER PUBLICATIONS

International Preliminary Report of corresponding PCT Application No. PCT/JP2018/026064 dated Jan. 30, 2020.
International Search Report of corresponding PCT Application No. PCT/JP2018/026064 dated Sep. 18, 2018.

*Primary Examiner* — Bryan M Lettman
(74) *Attorney, Agent, or Firm* — Global IP Counselors, LLP

(57) ABSTRACT

A rotary compressor includes a compression mechanism having a cylinder, a piston, and a Helmholtz muffler. The Helmholtz muffler has a resonance chamber in the compression mechanism and a communication groove formed on an end face of the cylinder to connect the cylinder and resonance chambers. The communication groove is open at the end face of the cylinder and has a pair of side wall portions and a bottom wall portion between the side wall portions. Each side wall portion has a first portion adjacent an open end of the communication groove and a second portion adjacent the bottom wall portion. A surface of the first
(Continued)

portion is a flat or bowed surface. A surface of the second portion is a bowed surface having a predetermined curvature so as to be connected to the surface of the first portion and a surface of the bottom wall portion.

2 Claims, 7 Drawing Sheets

(52) U.S. Cl.
CPC ..... *F04C 29/065* (2013.01); *F04C 2240/30* (2013.01); *F04C 2270/13* (2013.01)

(58) Field of Classification Search
CPC ..... F04C 2250/102; F04C 29/061; F04C 29/12; F04C 29/065; F04C 2270/13; F04C 29/06; F04C 29/128; F04C 29/126; F04C 29/124; F04C 2270/135; F04C 23/008; F04C 18/32–18/336; F04B 39/0061; F04B 39/0066; F04B 39/0088
See application file for complete search history.

(56) References Cited

U.S. PATENT DOCUMENTS

| | | | | |
|---|---|---|---|---|
| 6,447,274 | B1 * | 9/2002 | Horihata | F04C 29/065 418/179 |
| 11,060,522 | B2 * | 7/2021 | Morozumi | F04C 18/356 |
| 2008/0113538 | A1 | 5/2008 | Masuda | |
| 2010/0278675 | A1 * | 11/2010 | Han | F04C 18/3564 418/60 |
| 2015/0285250 | A1 | 10/2015 | Karim et al. | |

FOREIGN PATENT DOCUMENTS

| | | | |
|---|---|---|---|
| CN | 1499082 | A | 5/2004 |
| CN | 201486859 | U | 5/2010 |
| CN | 204646629 | U | 9/2015 |
| JP | 62-11200 | A | 1/1987 |
| JP | 2016-134335 | A | 7/2016 |
| JP | 2016-188760 | A | 11/2016 |

* cited by examiner

MUFFLER FOR A COMPRESSION MECHANISM OF A ROTARY COMPRESSOR

CROSS-REFERENCE TO RELATED APPLICATIONS

This U.S. National stage application claims priority under 35 U.S.C. § 119(a) to Japanese Patent Application No. 2017-140006, filed in Japan on Jul. 19, 2017, the entire contents of which are hereby incorporated herein by reference.

BACKGROUND

Field of the Invention

The present disclosure relates to a rotary compressor, and more particularly to a technique for reducing a dead volume caused by the provision of a Helmholtz muffler in a compression mechanism to reduce re-expansion loss.

Background Information

A rotary compressor, such as a rolling piston compressor or a swing piston compressor, has included a compression mechanism. The compression mechanism includes a cylinder having a cylinder chamber, and a piston rotating eccentrically in the cylinder chamber. The cylinder is generally an annular member, and axial end faces of the cylinder are respectively closed by a front head and a rear head.

Some of rotary compressors of this type include a compression mechanism including a Helmholtz muffler (see, for example, Japanese Examined Patent Publication No. S62-0112001. A Helmholtz muffler of such a compressor of Japanese Examined Patent Publication No. S62-011200 has a resonance chamber a small-volume space) provided in a cylinder of a compression mechanism, and a communication groove (a pressure introduction passage) formed on an end face of the cylinder to connect a cylinder chamber and the resonance chamber together. The Helmholtz muffler introduces gas from the cylinder chamber into the resonance chamber to produce resonance, thereby absorbing, and muffling. (energy of) sound having resonant frequencies in a predetermined band.

SUMMARY

The resonance frequency f of the Helmholtz muffler is expressed by the following formula:

$$f=(C/2\pi)(S/V(L+\delta))^{1/2}$$

where C represents the sound velocity, S represents the passage area, V represents the volume of the resonance chamber, L represents the passage length, and δ represents the opening end correction.

As can be seen, since a refrigerant having a low global warming potential has been used in recent years, and has its specific gravity reduced and its sound velocity increased (while a refrigerant R22 has a sound velocity C equal to 170 m/s, a refrigerant R32 has a sound velocity C equal to 230 m/s), the resonance frequency f tends to increase. Meanwhile, the frequency of sound arising from the structural resonance of the compressor does not vary among different refrigerants. Thus, the set frequency of the Helmholtz muffler needs to be adapted to the frequency of the sound arising from the structural resonance.

The formula indicated above shows that to maintain the resonance frequency f, the resonance chamber volume V needs to be increased, the passage ara S needs to be reduced, or the passage length L needs to be increased.

However, reducing the passage area S increases the passage pressure loss to prevent the Helmholtz muffler from functioning, and makes it difficult to machine the cylinder, resulting in an increase in cost. Increasing the passage length L causes the resonance chamber to be spaced apart from the cylinder chamber to increase the size of the cylinder, and increases the passage pressure loss to prevent the Helmholtz muffler from functioning.

As can be seen, it is actually difficult to reduce the passage area S or to increase the passage length, and in general, the Helmholtz muffler has a configuration in which increasing the resonance chamber volume V allows the resonance frequency f to be maintained to reliably muffle sound. However, in this case, the dead volume increases. The resultant re-expansion loss reduces the efficiency of the compressor.

It is an object of the present disclosure to allow a Helmholtz muffler to effectively muffle sound irrespective of the sound velocity of a refrigerant, and to reduce the degree to which the efficiency of a compressor decreases.

A first aspect of the present disclosure is predicated on a rotary compressor comprising: a compression mechanism (40) including a cylinder (42) having a cylinder chamber (51), a piston (53) rotating eccentrically inside the cylinder chamber (51), and a Helmholtz muffler (70), the Helmholtz muffler (70) having a resonance chamber (71) provided in the compression mechanism (40), and a communication groove (72) formed on an end face of the cylinder (42) to connect the cylinder chamber (51) and the resonance chamber (71) together.

This rotary compressor is characterized in that the communication groove (72) is a bottomed groove that is open at the end face of the cylinder (42), the communication groove (72) has a pair of side wall portions (73) and a bottom wall portion (74) located between the side wall portions (73), the side wall portions (73) each have a first portion (75) near an open end of the communication groove (72), and a second portion (76) near the bottom wall portion (74) of the communication groove (72), a surface of the first portion (75) is formed as a flat or bowed surface, and a surface of the second portion (76) is formed as a bowed surface having a predetermined curvature so as to be connected to the surface of the first portion (75) and a surface of the bottom wall portion (74).

In the foregoing configuration, the flat surface forming the surface of the first portion (75) may be a flat surface that allows the width of the cross section of the communication groove (72) to be constant in the height direction of the groove, or a flat surface that allows the width of the cross section to increase toward the bottom of the communication groove (72). The bowed surface forming the surface of the first portion (75) (the side wall portion (73)) may be a concave bowed surface that is bowed in a direction allowing the width of the cross section of the communication groove (72) to increase (see FIG. 7).

In this first aspect, the surface of the first portion (75) forming the side wall portion (73) of the communication groove (72) is a flat surface or a bowed surface, and the surface of the second portion (76) is a bowed surface having a predetermined curvature so as to be connected to the surface of the first portion (75) and a surface of the bottom wall portion (74). This can reduce the degree to which the pressure loss increases even if the passage area is reduced.

A second aspect of the present disclosure is an embodiment of the first aspect. In the second aspect, the surfaces of the first and second portions (75) and (76) may substantially equalize the flow rate of gas flowing through the communication groove (72) to reduce vortices.

In this second aspect, the flow rate of the gas flowing through the communication groove (72) is equalized, thereby reducing vortices.

A third aspect of the present disclosure is an embodiment of the first or second aspect. In the third aspect, the surface of the bottom wall portion (74) and the surfaces of a pair of the second portions (76) respectively connected to either end of the surface of the bottom wall portion (74) may be formed as one bowed surface having an arc-shaped cross section. In this case, the communication groove (72) can be shaped such that the first portion (75) is a flat surface, and the bottom wall portion (74) and the second portion (76) are arc-shaped (semicircular) bowed surfaces, or such that the first portion (75), bottom wall portion (74), and second portion (76) of the communication groove (72) are arc-shaped bowed surfaces.

In the third aspect, the surface of the bottom wall portion (74) and the surfaces of a pair of the second portions (76) respectively connected to either end of the surface of the bottom wall portion (74) are formed as one bowed surface having an arc-shaped cross section. This equalizes the flow rate of the gas flowing along the bowed surface, and reduces vortices.

A fourth aspect of the present disclosure is an embodiment of the third aspect. In the fourth aspect, the surface of the first portion (75) of the communication groove (72) may be formed as a flat surface, and a relation of $0.1 \leq h/r \leq 2.8$ may be satisfied, where h represents a height of the flat surface of the first portion (75) of the communication groove (72), and r represents a radius of the arc-shaped bowed surface.

A fifth aspect of the present disclosure is an embodiment of the fourth aspect. In the fifth aspect, h/r may be equal to one.

In the fourth and fifth aspects described above, the communication groove (72) has a rectangular upper portion and a semicircular lower portion as shown in FIG. 5, and satisfies the relation of $0.1 \leq h/r \leq 2.8$. Thus, the perimeter of this communication groove (72) is shorter than or equal to that of a communication groove (72) having a square cross-sectional shape, as shown in the graph of FIG. 6. This allows the pressure loss of the communication groove (72) of each of these aspects to be lower than or equal to that of the communication groove (72) having the square cross-sectional shape. In particular, in the fifth aspect, h/r is equal to one. This allows the perimeter ratio to be the smallest value (a value less than 0.95), thus reducing the pressure loss as well.

Advantages of the Invention

According to the first aspect, the surface of the first portion (75) forming the side wall portion (73) of the communication groove (72) is a flat surface or a bowed surface, and the surface of the second portion (76) is a bowed surface having a predetermined curvature so as to be connected to the surface of the first portion (75) and a surface of the bottom wall portion (74). This can reduce the degree to which the pressure loss increases even if the passage area is reduced. Thus, to maintain the resonance frequency f at the same value as in the known art, the passage area can be reduced. This eliminates the need for increasing the volume V of the resonance chamber (71) or the need for increasing the passage length L. Thus, since the volume of the resonance chamber (71) serving as a dead volume does not have to be increased, the re-expansion loss is substantially prevented from increasing, and the degree to which the efficiency of the compressor decreases can be reduced. Even if a refrigerant having a small specific gravity is used, the function of the Helmholtz muffler (70) can be maintained without increasing the passage cross-sectional area. This allows the Helmholtz muffler (70) to effectively muffle sound irrespective of the sound velocity of the refrigerant.

According to the second aspect, the surfaces of the first and second portions (75) and (76) forming the side wall portion (73) of the communication groove (72) substantially equalize the flow rate of gas flowing through the communication groove (72) to reduce vortices. This can more effectively reduce the degree to which the pressure loss increases even if the passage cross-sectional area is reduced. Thus, as in the first aspect, since the volume of the resonance chamber (71) serving as a dead volume does not have to be increased, the re-expansion loss is substantially prevented from increasing, and the degree to which the efficiency of the compressor decreases can be reduced. Even if a refrigerant having a small specific gravity is used, the function of the Helmholtz muffler (70) can be maintained without increasing the passage cross-sectional area. This allows the Helmholtz muffler (70) to effectively muffle sound irrespective of the sound velocity of the refrigerant.

According to the third aspect, the surface of the bottom wall portion (74) and the surfaces of a pair of the second portions (76) respectively connected to either end of the surface of the bottom wall portion (74) are formed as one bowed surface having an arc-shaped cross section. This can more reliably reduce the degree to which the pressure loss increases even if the passage area is reduced. Thus, as in the first and second aspects, since the volume of the resonance chamber (71) serving as a dead volume does not have to be increased, the r-expansion loss is substantially prevented from increasing, and the degree to which the efficiency of the compressor decreases can be reduced. Even if a refrigerant having a small specific gravity is used, the function of the Helmholtz muffler (70) can be maintained without increasing the passage cross-sectional area. This allows the Helmholtz muffler (70) to effectively muffle sound irrespective of the sound velocity of the refrigerant.

According to the fourth and fifth aspects, if h/r satisfies the foregoing range, and the passage has the same perimeter (pressure loss) as that of the square cross-sectional shape, the passage area S can be reduced. This can reduce the volume V of the resonance chamber (71). Thus, the re-expansion loss can be reduced. If the communication groove (72) has a shape that allows the communication groove (72) to have an equivalent pressure loss, the passage cross-sectional area of the communication groove (72) can be reduced. Thus, the set frequency of the Helmholtz muffler (70) can also be reduced without increasing the volume of a resonance chamber.

Further, since the communication groove (72) has a semicircular bottom surface, the amount of vortices is reduced, and the amount of actually resonating gas increases, thus reducing pulsations. This improves the efficiency of the Helmholtz muffler (70).

DETAILED DESCRIPTION OF EMBODIMENT(S)

Embodiments will now be described in detail with reference to the drawings.

Figure 1:
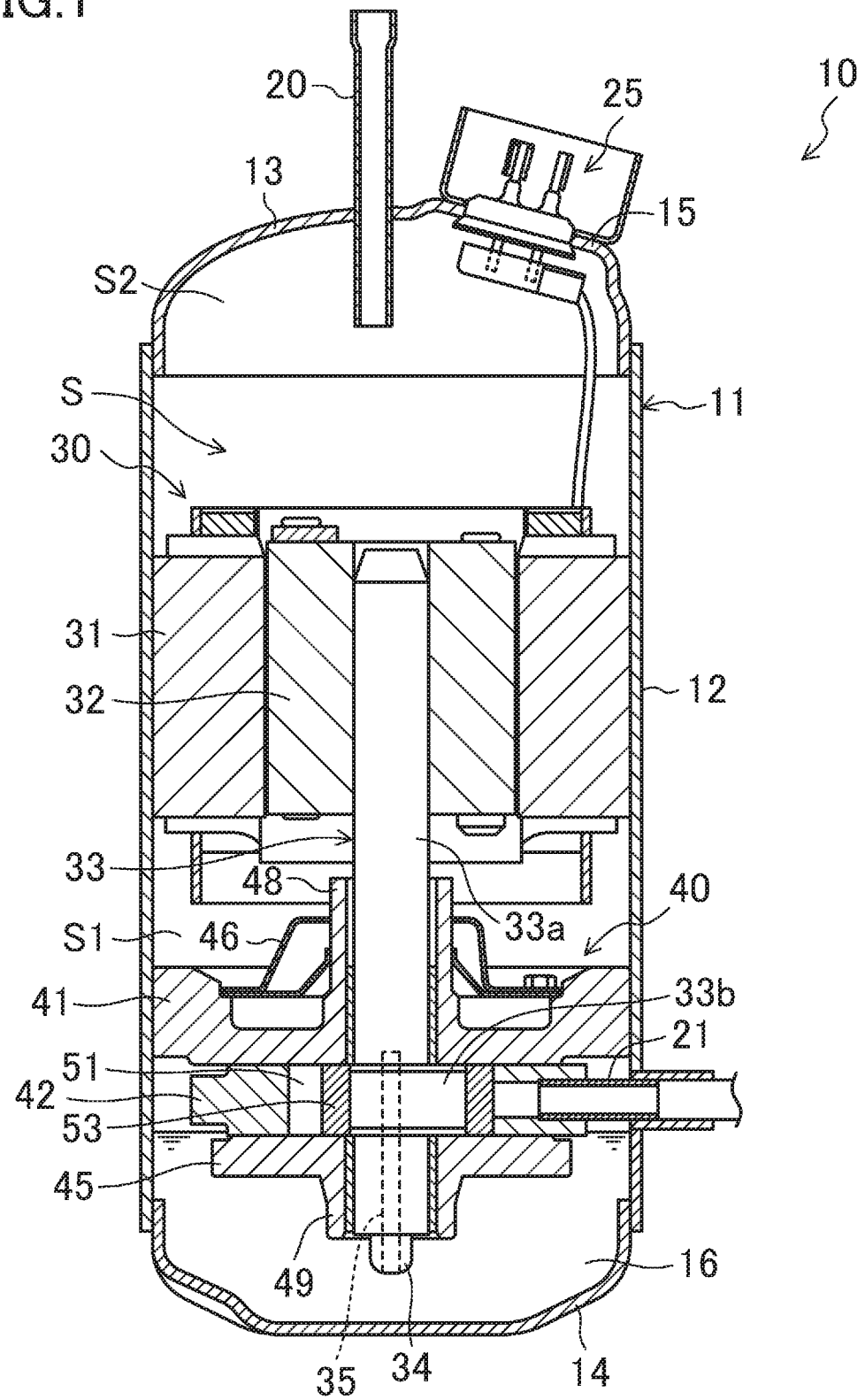
FIG. 1 is a longitudinal sectional view illustrating an overall structure rotary compressor according to an embodiment.

A rotary compressor (10) according to the embodiment shown in FIG. 1 is for use in a refrigeration apparatus for an air conditioner, a cooling apparatus, a hot water supply apparatus, or any other apparatus. The rotary compressor (10) is connected to a refrigerant circuit together with a condenser, an expansion valve (a decompression mechanism), and an evaporator. The refrigerant circuit allows a refrigerant to circulate to perform a refrigeration cycle. In other words, in the refrigerant circuit, a refrigerant compressed by the rotary compressor (10) condenses in the condenser. The refrigerant that has condensed is decompressed at the expansion valve, and then evaporates in the evaporator.

<General Configuration of Rotary Compressor>

The rotary compressor (10) includes a casing (11) that is a hermetically-sealed container with a vertically oriented cylindrical shape. The casing (11) includes a cylindrical barrel (12), and upper and lower end plates (13) and (14) respectively fixed on upper and lower ends of the barrel (12). The upper end plate (13) is formed in the shape of a bowl that opens downward, and has a lower end having an outer peripheral portion welded to an inner peripheral surface of the upper end of the barrel (12). The lower end plate (14) is formed in the shape of a bowl that opens upward, and has an upper end having an outer peripheral portion welded to an inner peripheral surface of the lower end of the barrel (12).

A discharge pipe (20) extends vertically to pass through a central portion of the upper end plate (13). The upper end plate (13) has a protrusion (15) protruding obliquely upward. The protrusion (15) has an upper surface configured as a flat surface. A terminal (25) is attached to the protrusion (15) to supply electric power from an external power source to an electric motor (30).

The casing (11) includes therein the electric motor (30) and a compression mechanism (40).

The electric motor (30) is disposed above the compression mechanism (40). The electric motor (30) includes a stator (31) and a rotor (32). The stator (31) is fixed to the inner peripheral surface of the barrel (12) of the casing (11). The rotor (32) is disposed inside the stator (31). The rotor (32) is coupled to a drive shaft (33) extending vertically inside the casing (11). The internal space (S) of the casing (11) is partitioned into a primary space (S) under the electric motor (30), and a secondary space (S2) over the electric motor (30). These spaces (S1, S2) are both filled with a fluid (a high-pressure refrigerant) discharged from the compression mechanism (40). That is to say, the compressor (10) is a so-called high-pressure dome type compressor (including a casing (11) having a high internal pressure).

The drive shaft (33) includes a main shaft portion (33*a*) and an eccentric portion (33*b*). The main shaft portion (33*a*) is rotatably supported by a main bearing (48) and an auxiliary bearing (49) of the compression mechanism (40).

A centrifugal oil pump (34) is attached to a lower portion of the drive shaft (33). The oil pump (34) is immersed in oil accumulated in an oil sump (16) at the bottom of the casing (11). The drive shaft (33) has therein an oil passage (35) through which oil pumped up by the oil pump (34) flows. The oil passage (35) extends axially through the drive shaft (33), and has a downstream portion continuous with a plurality of oil feed holes (not shown). Each oil feed hole has a starting end communicating with the oil passage (35), and an ending end opening toward an outer periphery of the drive shaft (33), and opens toward an inner peripheral surface of the main bearing (48), an inner peripheral surface of a piston (53), which will be described below, and an inner peripheral surface of the auxiliary bearing (49).

The oil pump (34) rotating together with the drive shaft (33) allows oil in the oil sump (16) to be sucked into the oil pump (34). The oil flows from the oil passage (35) separately to the oil feed holes, and is used to lubricate slide members.

<Compression Mechanism>

Figure 2:
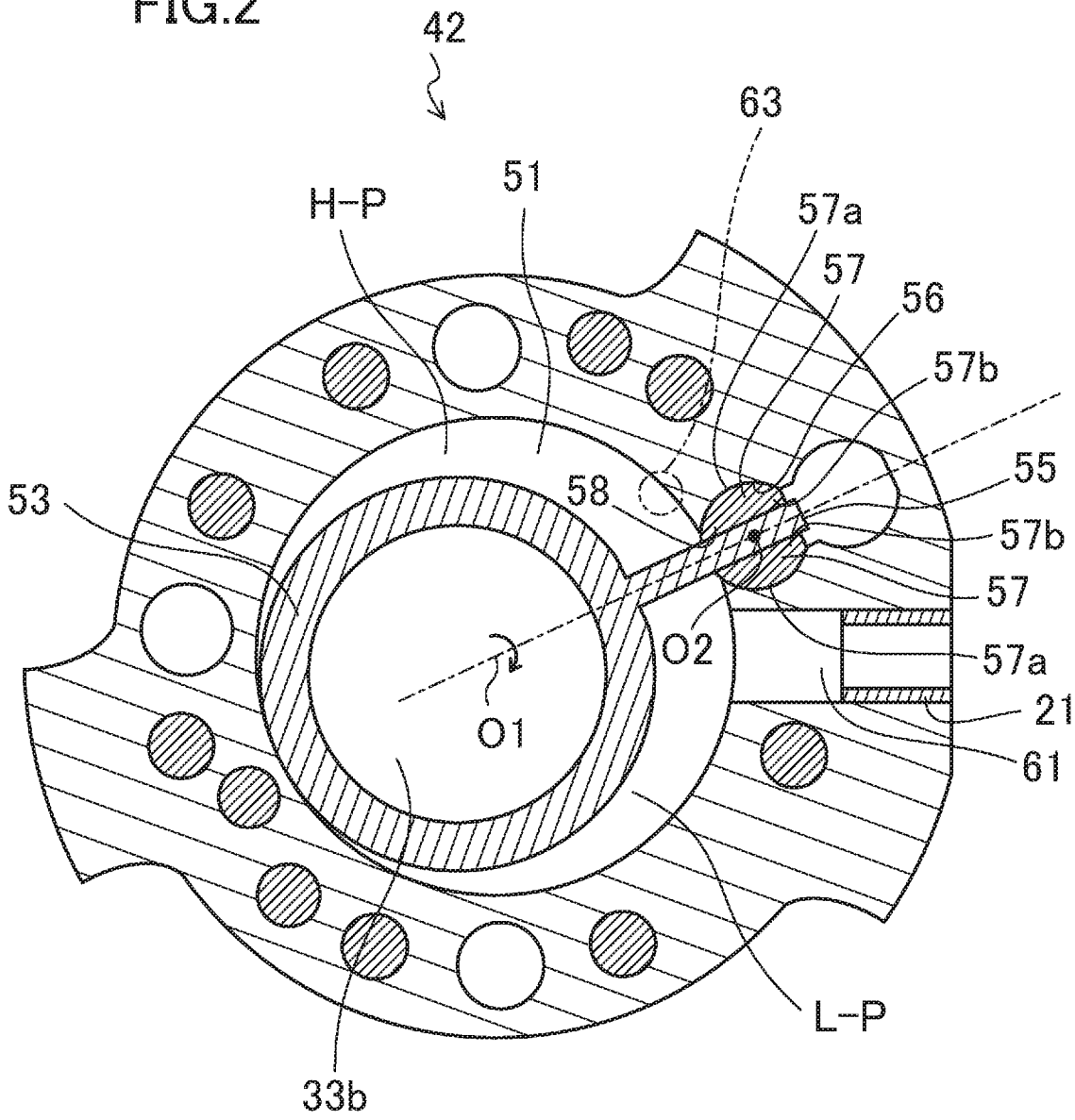
FIG. 2 is a horizontal cross-sectional view of a compression mechanism.

As shown in FIG. 2, the compression mechanism (40) is configured to compress a refrigerant in the compression chamber. The compression mechanism (40) is configured as a rotary compression mechanism including the annular cylinder (42) and the piston (53) rotating eccentrically inside the cylinder (42). More specifically, the compression mechanism (40) is configured as a swing piston compression mechanism, which includes a blade (55) held between a pair of bushes (57), and the piston (53) integrated with the blade (55). The piston (53) rotates while swinging in the cylinder (42).

The compression mechanism (40) is fixed near a lower portion of the barrel (12) of the casing (11). The compression mechanism (40) includes the front head (41) serving as a first cylinder head, the cylinder (42), and the rear head (45) serving as a second cylinder head. The front head (41), the cylinder (42), and the rear head (45) are stacked in this order from its upper end to its lower end. The front head (41) is fixed to the inner peripheral surface of the barrel (12) of the casing (11). A central portion of the front head (41) includes the main bearing (48) protruding upward. The cylinder (42) is formed in an annular shape having upper and lower circular opening surfaces. A central portion of the rear head (45) includes the auxiliary bearing (49) protruding downward.

In the compression mechanism (40), the upper opening surface (the upper end face in the axial direction) of the cylinder (42) is closed by the front head (41), and the lower opening surface (the lower end face in the axial direction) of the cylinder (42) is closed by the rear head (45). Thus, a cylinder chamber (51) is defined inside the cylinder (42).

The cylinder chamber (51) houses the annular piston (53) through which the eccentric portion (33*b*) is inserted. The cylinder (42) is connected to a suction pipe (21) extending radially. The suction pipe (21) communicates with a suction chamber (a low-pressure chamber) of the cylinder chamber (51).

The front head (41) has a discharge port (63) (not shown in FIG. 1). The discharge port has an inlet end communicating with a discharge chamber (a high-pressure chamber) of the cylinder chamber (51). An outlet end of the discharge port opens into a muffler member (46). The inside of the muffler member (46) communicates with the primary space (S) through a communication port (not shown).

Next, the internal structure of the cylinder (42) will be described.

The cylinder chamber (51) houses the annular piston (53). The eccentric portion (a crankshaft (33*b*)) is fitted into the piston (53). Thus, the axis of rotation of the piston (53) is eccentric to the axis O1 of the main shaft portion (33*a*) of the drive shaft (33). The blade (55) is coupled to the outer peripheral surface of the piston (53). The blade (55) is formed in the shape of a vertically oriented rectangular parallelepiped extending radially outward from the outer peripheral surface of the piston (53).

On the other hand, the cylinder (42) has a substantially circular bush hole (56). The bush hole (56) is formed inside the outer peripheral surface of the cylinder chamber (51) to communicate with the cylinder chamber (51). The pair of bushes (57, 57) are fitted into the bush hole (56). The bushes (57) each have a substantially bow-shaped cross-sectional shape when cut in a direction perpendicular to the axis thereof. The bushes (57) each have an arc portion (57*a*) that is in sliding contact with the inner peripheral surface of the bush hole (56), and a flat portion (57*b*) that forms a flat surface. In the bush hole (56), the flat portions (57*b*, 57*b*) of the pair of bushes (57, 57) face each other, and a blade groove (58) is formed between the flat portions (57*b*, 57*b*). The blade (55) described above is inserted through the blade groove (58). This allows the blade (55) to be radially slidably held by the bushes (57, 57), which are swingable about the arc center O2 of the arc portion (57*a*) in the bush hole (56). As a result, the piston (53) rotates eccentrically along the inner peripheral surface of the cylinder chamber (51) while being in sliding contact with the inner peripheral surface.

The cylinder chamber (51) is partitioned into a low-pressure chamber (L-P) and a high-pressure chamber (H-P) by the blade (55). Specifically, the cylinder chamber (51) has the low-pressure chamber (L-P) defined on one side (a lower right side in FIG. 2) of the blade (55), and the high-pressure chamber (H-P) defined on the other side (an upper left side in FIG. 2) of the blade (55).

The cylinder (42) has a suction port (61) connected to the suction pipe (21) described above. The suction port (61) is formed near one of the pair of bushes (57) closer to the low-pressure chamber (L-P). The suction port (61) extends radially such that one end thereof opens to the cylinder chamber (51) and the other end thereof opens to the outside of the cylinder (42). The suction port (61) has inlet and outlet ends respectively communicating with the suction pipe (21) and the low pressure chamber (L-P) of the cylinder chamber (51).

The discharge port (63) described above is formed on the upper side of the high-pressure chamber (H-P) of the cylinder chamber (51). Specifically, the discharge port (63) passes through the front head (41) in the axial direction so that the inlet and outlet ends thereof respectively communicate with the high-pressure chamber (H-P) of the cylinder chamber (51) and the inside of the muffler member (46).

<Helmholtz Muffler>

The compression mechanism (40) of the compressor (10) includes a Helmholtz muffler (70). The Helmholtz muffler (70) introduces gas from the cylinder chamber (51) into a resonance chamber (71) to produce resonance, thereby absorbing, and muffling, (energy of) sound having resonant frequencies in a predetermined band. The Helmholtz muffler (70) of this embodiment will now be described with reference to FIGS. 3 to 6.

Figure 3:
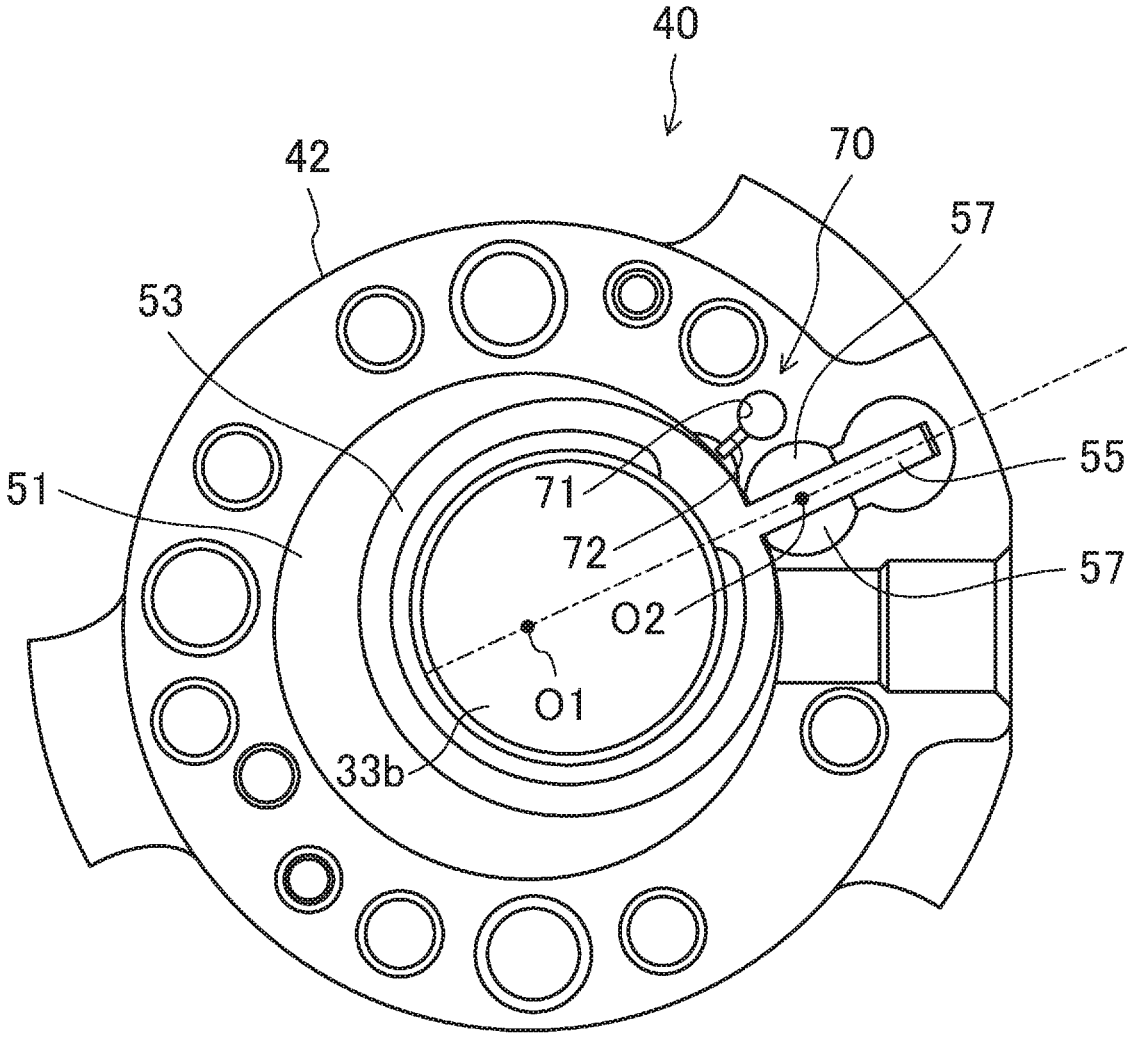
FIG. 3 is a plan view of the compression mechanism from which a front head is removed.
Figure 4:
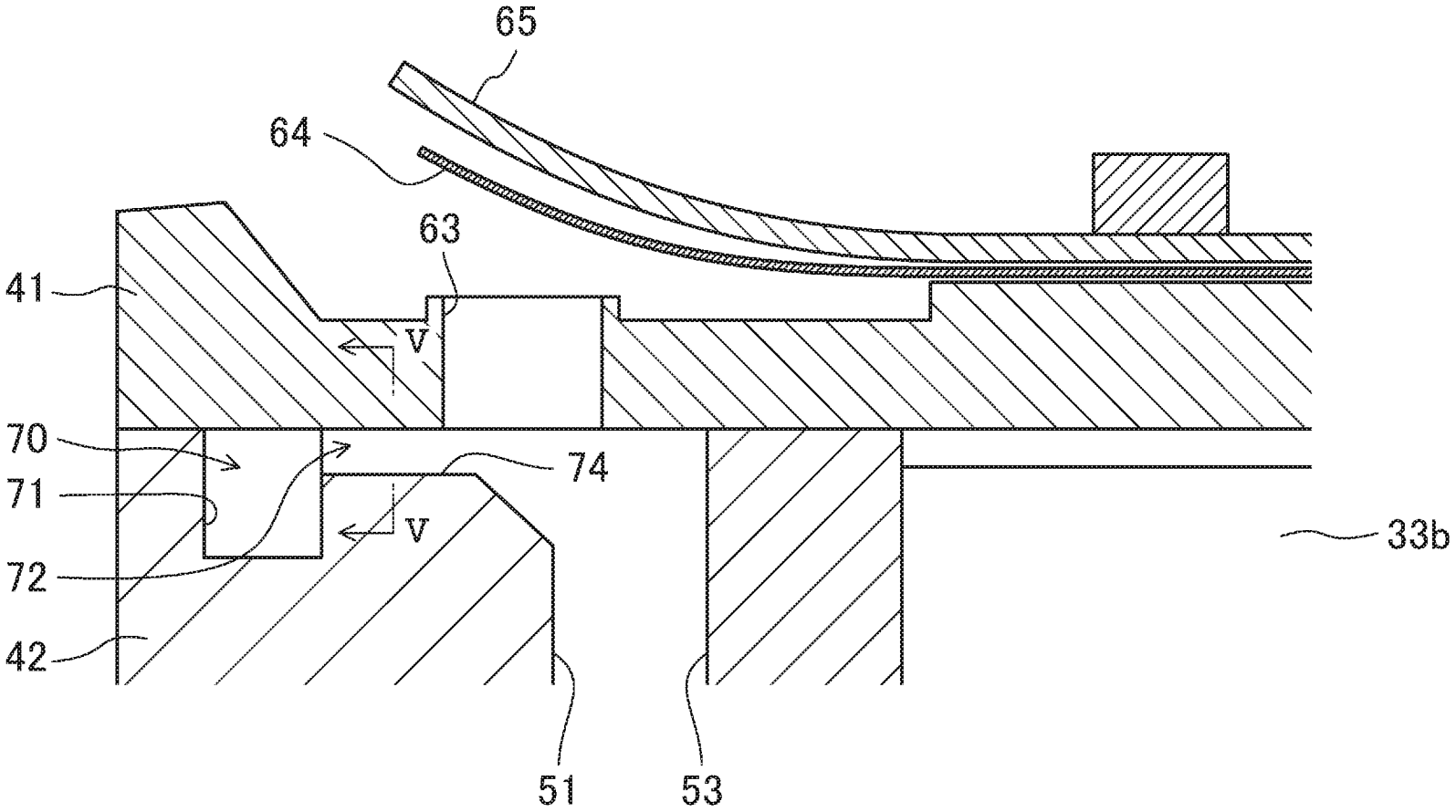
FIG. 4 is a cross-sectional view of an essential portion of the compression mechanism, and illustrates a configuration of a Helmholtz muffler.
Figure 5:
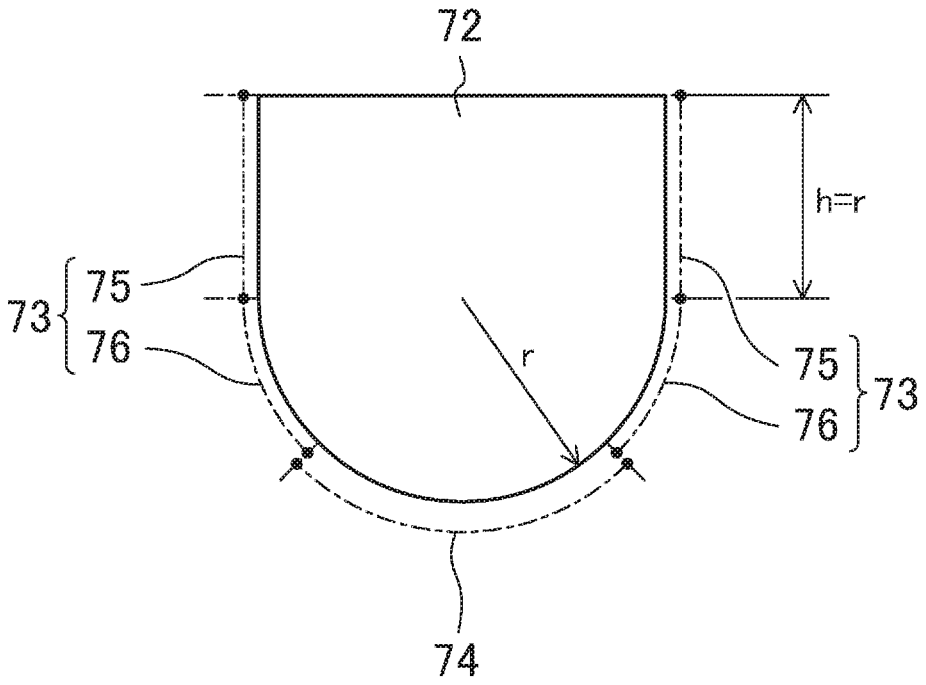
FIG. 5 is a cross-sectional view taken along line V-V shown in FIG. 4.
Figure 6:
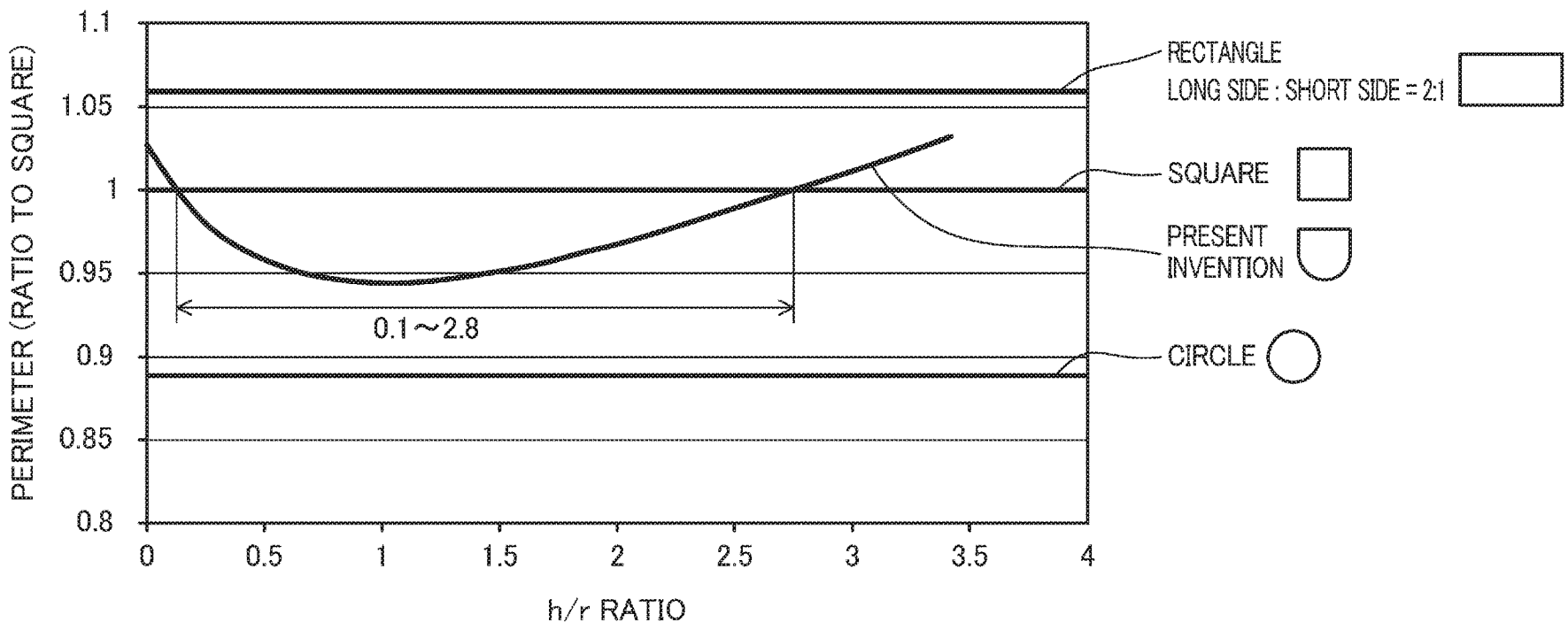
FIG. 6 is a graph showing the perimeter ratio between communication grooves having the same cross-sectional area and different cross-sectional shapes if the shape of a communication groove of a Helmholtz muffler is varied.

FIG. 3 is a view of the compression mechanism (40) as viewed from the upper surface of the cylinder (42) (a plan view of the compression mechanism (40) from which the front head (41) is removed), FIG. 4 is a cross-sectional view of an essential portion of the compression mechanism (40), and illustrates a configuration of the Helmholtz muffler (70), FIG. 5 is a cross-sectional view taken along line V-V shown in FIG. 4, and FIG. 6 is a graph showing the perimeter ratios between communication grooves (72) of the Helmholtz muffler (70) having the same cross-sectional area and different cross-sectional shapes.

The Helmholtz muffler (70) has the resonance chamber (71) formed in an end face of the cylinder (42) of the compression mechanism (40), and a communication groove (72) formed on the end face of the cylinder (42) to connect the cylinder chamber (51) and the resonance chamber (71) together.

The resonance chamber (71) is a space that is open at the end face of the cylinder (42). The communication groove (72) is a bottomed groove that is open at the end face of the cylinder (42). When the end face of the cylinder (42) is closed by the front head (41), an end of the resonance chamber (71) and an end of the communication groove (72) both closer to the end face of the cylinder (42) are closed so that the resonance chamber (71) communicates with the cylinder chamber (51) only through the communication groove (72).

The communication groove (72) includes a pair of side wall portions (73) and a bottom wall portion (74) located between the side wall portions (73). Each side wall portion (73) has a first portion (75) near the open end of the communication groove (72), and a second portion (76) near the bottom wall portion (74) of the communication groove (72). Surfaces of a pair of the first portions (75) are formed as flat surfaces parallel to each other. Surfaces of a pair of the second portions (76) are formed as bowed surfaces each having a predetermined curvature so as to be connected to a surface of an associated one of the first portions (75) and a surface of the bottom wall portions (74).

The surfaces of each first portion (75) and the associated second portion (76) are configured as surfaces that are smoothly continuous to substantially equalize the flow rate of gas flowing through the communication groove (72) to reduce vortices.

Specifically, the surface of the bottom wall portion (74) and the surfaces of the pair of second portions (76) respectively connected to either end of the surface of the bottom wall portion (74) are formed as one bowed surface (77) having an arc-shaped cross section having a predetermined curvature. The bowed surface (77) is specifically a bowed surface having a semicircular cross section (having a radius r). That is to say, as shown in FIG. 5, the communication groove (72) of this embodiment has an upper portion having a rectangular cross-sectional shape, and a lower portion having a semicircular cross-sectional shape. The surfaces of the second portions (76) are formed as bowed surfaces that substantially equalize the flow rate of gas flowing through the communication groove (72) to reduce vortices. In other words, the bowed surfaces each form a curved surface having a relatively small curvature, i.e., a curved surface having a relatively large radius.

A perimeter of a cross section of the communication groove (72) being configured to be shorter than a perimeter of a different communication groove having a square cross-sectional shape in which the communication grooves have equal cross-sectional areas.

On the other hand, as shown in FIG. 4, the front head (41) has the discharge port (63). The front head (41) is provided with a discharge valve (reed valve) (64) for opening and closing the discharge port (63), and a valve guard (65) for regulating the lift amount of the discharge valve (64).

Here, as shown in FIG. 5, the communication groove (72) of this embodiment is defined by the following formula:

$$h/r=1$$

where h represents the height of the flat surface of the first portion (75), and r represents the radius of the bowed surface.

The relation between the height h of the flat surface of the first portion (75) and the radius r of the bowed surface should not be limited to h/r=1, but merely needs to satisfy the relation of $0.1 \leq h/r \leq 2.8$.

—Operation—

An operation of the rotary compressor (10) according to this embodiment will be described with reference to FIGS. 1 to 3. Turning on a power source outside the casing (11) allows external power to be supplied to the terminal (25). As a result, electric current is supplied from the terminal (25) to the electric motor (30) via a lead wire, and the electric motor (30) is operated.

The electric motor (30) in operating state allows the rotor (32) to rotate inside the stator (31). This triggers rotation of the drive shaft (33), and the piston (53) rotates eccentrically inside the cylinder chamber (51). As a result, a refrigerant is compressed in the cylinder chamber (51).

Specifically, in the cylinder chamber (51), the volume of the low-pressure chamber (L-P) gradually increases in response to the rotation of the piston (53) shown in FIG. 2. This allows a low-pressure and low-temperature refrigerant to be sucked into the low-pressure chamber (L-P) from the suction pipe (21) and the suction port (61). If the piston (53) further rotates, and the low-pressure chamber (L-P) is disconnected from the suction port (61), the low-pressure chamber (L-P) turns into the high-pressure chamber (H-P). Then, further rotation of the piston (53) allows the volume of the high-pressure chamber (H-P) to gradually decrease. Thus, the refrigerant is compressed in the high-pressure chamber (H-P). If the high-pressure chamber (H-P) communicates with the discharge port (63), and the pressure of the high-pressure chamber (H-P) exceeds a predetermined value, the discharge valve of the discharge port (63) is pushed up, and the discharge port (63) is opened.

The refrigerant discharged upward from the discharge port (63) flows out into the muffler member (46), and is sent to the primary space (S). The refrigerant flowing out into the primary space (S1) flows upward through a clearance of a slot of the stator (31) of the electric motor (30) and a clearance of a core cut of the stator (31), and flows out into the secondary space (S2) above the electric motor (30). At this time, oil contained in the refrigerant is separated from the refrigerant. The refrigerant from which the oil has been separated flows into the discharge pipe (20), and is sent to the outside of the discharge pipe (20).

The Helmholtz muffler (70) introduces gas from the cylinder chamber (51) into the resonance chamber (71) to produce resonance, thereby absorbing, and muffling, (energy of) sound having resonant frequencies in a predetermined band.

Advantages of Embodiment

The range of h/r of this embodiment is determined based on the graph shown in FIG. 6. FIG. 6 shows the perimeter ratios between communication grooves (72) respectively having a square cross-sectional shape, a rectangular cross-sectional shape (where the ratio of the long side to short side of the rectangle is 2 to 1), a circular cross-sectional shape, and the cross-sectional shape of this embodiment (having a rectangular upper portion and a semicircular groove-shaped lower portion) and all having the same cross-sectional area.

As shown in the graph, the perimeter of the communication groove (72) having the rectangular cross-sectional shape is (about 1.06 times) longer than that of the communication groove (72) having the square cross-sectional shape if these grooves have the same cross-sectional area. Thus, the area of contact between gas and the communication groove (72) having the rectangular cross section is larger than that of contact between gas and the communication groove (72) having the square cross section, resulting in an increase in pressure loss. The perimeter of the communication groove (72) having the circular cross-sectional shape is (about 0.89 times) shorter than that of the communication groove (72) having the square cross-sectional shape if these grooves have the same cross-sectional area. This helps reduce the pressure loss, but makes it difficult to machine the communication groove (72).

On the other hand, the perimeter of the communication groove (72) having a cross section having the shape of this embodiment (having a rectangular upper portion and a semicircular lower portion) is shorter than or equal to that of the communication groove (72) having the square cross-sectional shape as shown in FIG. 6 as long as the relation of $0.1 \leq h/r \leq \leq 2.8$ is satisfied. Accordingly, the pressure loss in the passage is also less than or equal to that in the passage having the square cross section. In particular, if h/r is equal to one, the perimeter ratio is the smallest value (0.94). Thus, the pressure loss is also reduced.

Here, the resonance frequency f of the Helmholtz muffler is expressed by the following formula:

$$f=(C/2\pi)(SN(L+\delta))^{1/2}$$

where C represents the sound velocity, S represents the passage area, V represents the volume of the resonance chamber, L represents the passage length, and δ represents the opening end correction, as described above. In this embodiment, h/r satisfies the foregoing range. Thus, if the passage cross-sectional area is the same as that of the square cross section, the perimeter of the passage decreases to reduce the pressure loss. This improves the efficiency of the Helmholtz muffler. In addition, in this embodiment, if the passage has the same perimeter (the same pressure loss) as that of the square cross section, the passage area S can be reduced. This can reduce the volume V of the resonance chamber. Thus, according to this embodiment, the re-expansion loss can be reduced.

Further, even if the passage cross-sectional area is reduced, the pressure loss of the communication groove is reduced to a level equivalent to that obtained if the communication groove has the square cross section. Thus, if the resonance chamber (71) is designed such that its volume serving as a dead volume does not increase, the set frequency of the Helmholtz muffler (70) can also be reduced.

Further, since the communication groove (72) of this embodiment has a semicircular bottom surface, the amount of vortices is reduced, and the amount of actually resonating gas increases, thus reducing pulsations. This improves the efficiency of the Helmholtz muffler (70).

Further, in this embodiment, only the cylinder (42) needs to have the communication groove (72). Thus, a rear head (a lower bearing end plate) of the rotary compressor of the known art (Patent Document 1) having a communication groove becomes thinner, and may thus be deformed due to the pressure difference, whereas this embodiment can reduce the deformation of the cylinder head (rear head) due to the pressure difference. In a case where a groove is formed over two parts, i.e., the cylinder (42) and the front head (41), the two parts need to be machined to form the groove. However, this embodiment allows cost to be lower than in this case. Further, since the communication groove (72) of this embodiment can be machined with a ball end mill, it can be machined at low cost, and is suitable for being machined on one part (a cylinder) in the shape of a groove.

OTHER EMBODIMENTS

The foregoing embodiment may be modified as follows.

Figure 7:
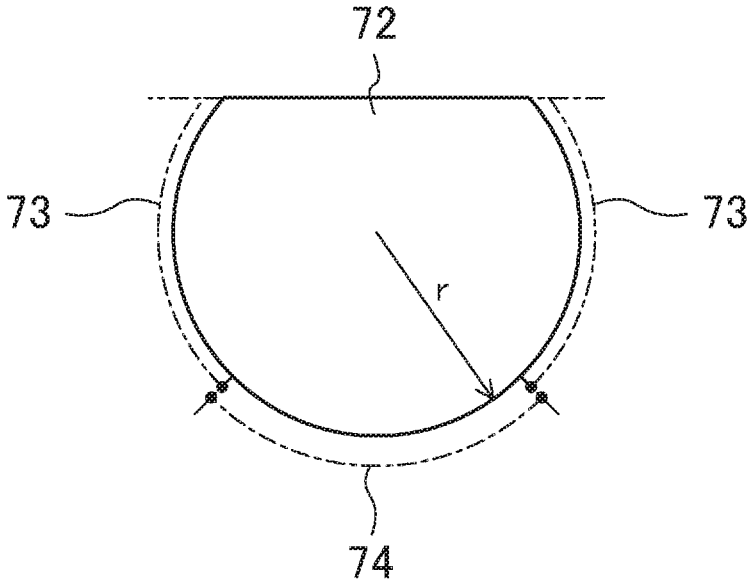
FIG. 7 is a cross-sectional view showing a variation of the communication grooves.

In the foregoing embodiment, the communication groove (72) has the upper portion having a rectangular cross-sectional shape, and the lower portion having a semicircular cross-sectional shape. However, as shown in FIG. 7, the side wall portions (73) and the bottom wall portion (74) may be entirely configured as one curved surface having an arc-shaped cross section. This also equalizes the flow rate of gas flowing through the inside of the groove, thereby reducing the pressure loss. This can provide advantages similar to those of the foregoing embodiment.

In some cases, in FIG. 5, the pair of flat surfaces of the first portions (75) of the side wall portions (73) may be configured as inclined surfaces which are not parallel to each other and between which the distance increases downward of the communication groove (72).

In the foregoing embodiment, the cylinder (42) has the resonance chamber (71). However, the cylinder (42) does not always need to have the resonance chamber (71), and the compression mechanism (40) merely needs to have the resonance chamber (71).

In the foregoing embodiment, the Helmholtz muffler (70) is provided at the discharge port (63). However, the position of the Helmholtz muffler may be appropriately changed as long as the resonance chamber (71) communicates with the cylinder chamber (51) through the communication groove (72).

Note that the foregoing description of the embodiments is a merely preferred example in nature, and is not intended to limit the scope, application, or uses of the present disclosure.

As can be seen from the foregoing description, the present disclosure is useful for a technique for reducing a dead volume caused by the provision of a Helmholtz muffler in a compression mechanism of a rotary compressor to reduce re-expansion loss.

What is claimed is:

1. A rotary compressor comprising:

a compression mechanism including a cylinder having a cylinder chamber, a piston rotating eccentrically inside the cylinder chamber, and a Helmholtz muffler, the Helmholtz muffler having a resonance chamber provided in the compression mechanism, and a communication groove formed on an end face of the cylinder to connect the cylinder chamber and the resonance chamber together, the communication groove being a bottomed groove that is open at the end face of the cylinder, the communication groove having a pair of side wall portions and a bottom wall portion located between the side wall portions, the side wall portions each having a first portion adjacent an open end of the communication groove, and a second portion adjacent the bottom wall portion, a surface of the first portion being formed as a flat surface, a surface of the second portion being formed as a bowed surface having a predetermined curvature so as to be connected to the surface of the first portion and a surface of the bottom wall portion, the surface of the bottom wall portion and the surfaces of a pair of the second portions respectively connected to either end of the surface of the bottom wall portion being formed as one bowed surface having an arc-shaped cross section, the surface of the first portion of each of the side wall portions of the communication groove being formed as a flat surface, and a relation of $0.1 \leq h/r \leq 2.8$ being satisfied, where h represents a height of the flat surface of the first portion of the communication groove, and r represents a radius of the bowed surface of the second portion having the arc-shaped cross-section, a perimeter of a cross section of the communication groove being configured to be shorter than a perimeter of a different communication groove having a square cross-sectional shape in which the communication grooves have equal cross-sectional areas.

2. The rotary compressor of claim 1, wherein h/r is equal to one.

* * * * *